United States Patent [19]

Wasley

[11] Patent Number: 4,640,426

[45] Date of Patent: Feb. 3, 1987

[54] CAP FOR A CARBONATED BEVERAGE BOTTLE

[76] Inventor: Bernard Wasley, 212-11 85th Ave., Jamaica, N.Y. 11427

[21] Appl. No.: 826,921

[22] Filed: Feb. 7, 1986

[51] Int. Cl.[4] ..... B65D 51/24

[52] U.S. Cl. ..... 215/228; 53/88; 417/478

[58] Field of Search ..... 215/228, 260; 417/478, 417/472; 53/88

[56] References Cited

U.S. PATENT DOCUMENTS

| | | | |
|---|---|---|---|
| 2,545,233 | 3/1951 | Kaufman | 215/260 X |
| 3,009,459 | 11/1961 | Ruben | 417/478 X |
| 3,557,986 | 1/1971 | Poole | 215/260 X |
| 4,033,091 | 7/1977 | Saponara | 215/228 |

*Primary Examiner*—Donald F. Norton

*Attorney, Agent, or Firm*—Nicholas J. Garofalo

[57] ABSTRACT

A bottle cap is disclosed for use as a closure and as means for pressurizing a previously opened bottle containing a carbonated beverage. It has a body adapted to close over the mouth of the bottle; and has a resilient manually compressible and relaxable bulb mounted to the body. The bulb functions as a pump in conjunction with inlet and discharge valves in the body to pressurize the interior of the bottle and its contents with air. A pressure release valve in the body responds to development of a pressurized condition in the bottle above a predetermined value to release the excess pressure to atmosphere.

5 Claims, 3 Drawing Figures

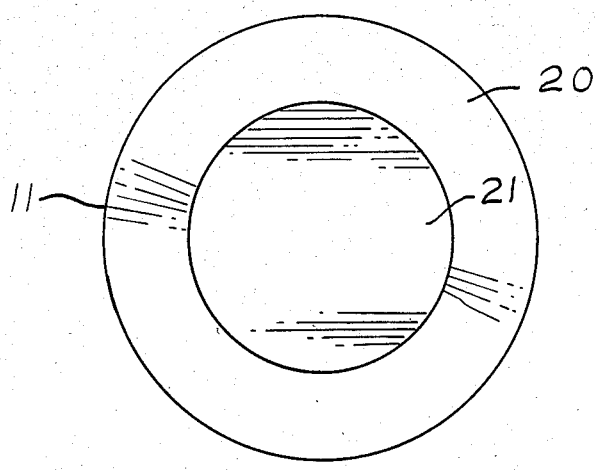
FIG. 2
FIG. 1
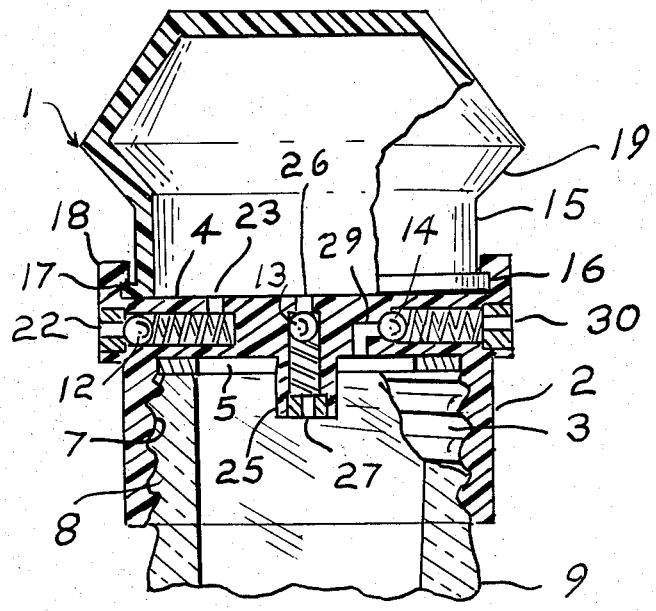
FIG. 3
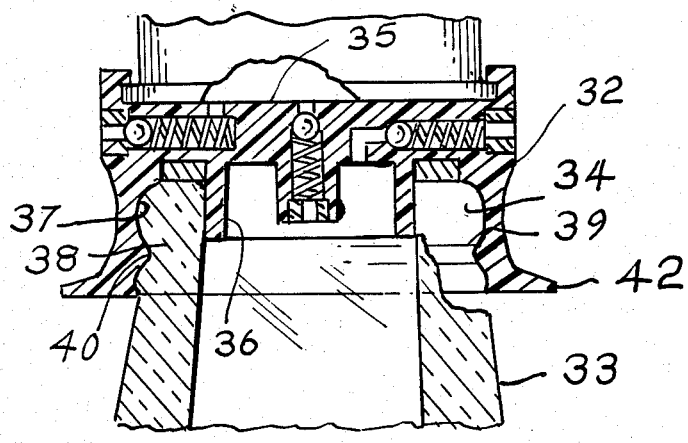

CAP FOR A CARBONATED BEVERAGE BOTTLE

BACKGROUND OF THE INVENTION

This invention is directed to an improved cap for bottles of carbonated beverages. It is designed to serve not only as a closure for the bottle, but also as a means for developing a desirable pressurized condition within the bottle and its contents after the bottle has been previously opened. The cap is preferably intended for use as a replacement for the original cap after the bottle has been opened.

The appeal of a carbonated beverage to the consumer is the sparkling escaping bubbles that pleasantly stir the imagination and pleasurably tingle the nose as one drinks a carbonated beverage poured from a freshly opened bottle. Unfortunately however, soon after the initial opening, much of the bubbly life of the beverage is progressively dissipated. The usual recapping of the once opened bottle and its subsequent storage tend to further reduce the bouyancy of the beverage. Subsequent pourings from the bottle are, accordingly, noticeably flat and without the pickle and tingle so characteristic of the beverage flowing from a freshly opened bottle.

The general purpose of the present invention is to provide an efficient and beneficial means for continuing the sparkling and bubbling attributes of a carbonated beverage after the bottle has been initially opened and until the contents of the bottle is exhausted.

And, more particularly, the object of this invention is to provide for a bottle containing a carbonated beverage a replacement cap which is adapted to serve both as an air pump for re-pressurizing the contents of a previously opened bottle and as a closure for maintaining the pressurized condition until the bottle is again opened.

BRIEF SUMMARY OF THE INVENTION

In accordance with the invention there is provided, for a bottle containing a carbonated beverage, a cap of elastomeric material having: a body adapted to be fitted to the neck of the bottle so as to cap and close its mouth; a resilient bulb mounted atop the body adapted to be alternately manually compressed and relaxed so as to cause outside air to be drawn through an inlet valve into the bulb and to then be pumped by the bulb through a discharge valve into the bottle until a desired pressure has developed within the bottle; and a pressure release valve which is responsive to development of a pressure within the bottle above a predetermined value to release the excess pressure to atmosphere and signal to the user that a desired pressure has been attained.

In one form, the body of the cap is adapted for screw engagement with a threaded neck of a bottle; and in another form, the body is adapted to be anchored upon an unthreaded neck of a bottle.

The foregoing, as well as other features, objects and advantages of the invention will appear more fully hereinafter from a consideration of the detailed description which follows when taken together with the accompanying drawing wherein an embodiment of the invention is illustrated. It is to be expressly understood, however, that the drawing is for purposes of illustration and description and is not to be construed as defining the limits of the invention.

BRIEF DESCRIPTION OF THE DRAWING

In the accompanying drawing:

FIG. 1 is a vertical section through a bottle cap embodying the invention, and shows the cap mounted to a carbonated beverage bottle having a threaded neck;

FIG. 2 is a top plan view of the cap; and

FIG. 3 is similar to that of FIG. 1, but shows the body of the cap modified for mounting to a bottle having an unthreaded neck.

DETAILED DESCRIPTION OF THE INVENTION

Reference is now directed to FIGS. 1 and 2 of the drawing, wherein the cap as a unit is generally designated by the numeral 1. The cap includes a body section 2 having an internal annular recess 3 which is closed at its upper end by a headpiece or top wall 4 and is open at its bottom end. Seated in the recess is a washer 5. The wall of the recess is provided with threads 7, whereby the body may be screwed onto the neck 8 of a carbonated beverage bottle 9 having complementary threads. When the cap is so mounted, the washer will be in sealing contact with the lip of the bottle.

The body 2 is preferably formed of elastomeric material. This enables it to obtain a snug or tight grip about the neck of the bottle. This fit, together with the sealing condition provided by the washer, effectively prevents dissipation of a pressurized internal condition of the bottle.

The cap further includes means for pressurizing with air the interior of the bottle and its contents to a predetermined value. This means includes a resilient bulb 11 of elastomeric material. The bulb is compressible under manual pressure, and expandable to normal shape upon release of the pressure.

The bulb, in conjunction with a group of valves 12, 13 and 14 located in the headpiece 4 of the body, is operable to pump air into the bottle to which the cap is mounted, so as to develop a desired pressurized condition in the bottle and its contents.

The bulb has a cylindrical lower portion or neck 15 which is open at its bottom. The bottom end is seated upon a flat upper surface of the headpiece. It is secured fast upon the latter by means of a rib 16 extending around its periphery and engaged in a complementary channel 17 in an upstanding annular shoulder 18 of the headpiece.

The upper end of the neck of the bulb merges into an outwardly and upwardly extending conical section 19; and the latter merges into an inwardly and upwardly extending further conical section 20. The latter section terminates into a flat closing top wall 21 for the bulb.

This form of the bulb is of decided advantage. It enables the bulb to be manually compressed and relaxed in a simple and efficient manner. In this respect, the user may position his first and second fingers about the neck of the bulb below the conical section 19. Then, he can with his thumb acting upon the top wall 21 effect alternate compression and relaxing of the bulb. Or, the user may effect this pumping action by alternately exerting a downward pressure with the palm of his hand upon the flat top of the bulb and then releasing such pressure as the bulb re-expands.

Valve 12, which is an air inlet valve, and valve 13, which is an air discharge valve, respond to the alternate compressing and relaxing action of the bulb in such manner as to allow outside air to be alternately drawn through valve 12 into the bulb and to be pumped by the latter through valve 13 into the recess 3 to the mouth of the bottle.

The inlet valve 12 is a ball valve movable in a radial chamber in the headpiece. The chamber connects an air inlet port 22 with an outlet port 23 that opens through the headpiece into the bottom open end of the bulb. The valve is normally seated claosed over the inlet port under the load of a coil spring.

The discharge valve 13 is a ball valve movable in a chamber of a stem 25 depending axially from the headpiece. The chamber connects a port 26 opening through the headpiece into the open bottom of the bulb with a discharge port 27 opening into the recess 3. The valve is normally seated closed over port 26 under the load of a coil spring.

Valve 14 is a pressure release ball valve movable in a radial chamber in the headpiece. The chamber connects a release port 29 opening through the headpiece into the recess 3 with an escape port 30 to atmosphere. The valve is normally seated closed over port 29 under the load of a coil spring.

In the employment of the invention, the body of the cap is screwed onto the neck of the bottle until the washer 5 is seated against the lip of the bottle. The open mouth of the bottle will be exposed to the pressure discharge and release ports 27 and 29. Next, the bulb is manually alternately compressed and allowed to relax. On the compression stroke, air forced from the bulb will unseat the discharge valve 13 and pass through port 27 into the bottle. On the relaxing stroke, suction created by the expanding bulb will unseat the air inlet valve 12 and draw inlet air through port 23 into the bulb. As alternate compressing and relaxing of the bulb is continued, the interior of the bottle and its contents will be progressively pressurized. When this pressure exceeds a predetermined value, excess pressure air will unseat the release valve 14 and exit through port 30 to atmosphere.

The cap shown in FIG. 3 is the same as that in FIG. 1, except that it is modified in its body 32 to enable it to be mounted and anchored to a bottle 33 having an unthreaded or smooth neck.

The body of the cap in FIG. 3 has a cylindrical internal recess 34 which is closed at its top by a headpiece 35 and is open at its bottom. A stub tube 36 concentric with the wall of the recess and of smaller diameter depends axially from the headpiece. The annular space 37 between the stub tube and the wall of the recess compliments the thickness of the neck 38 of the bottle to be received in the recess. In this respect, when the body of the cap is mounted to the bottle, the stub tube depends into the mouth of the bottle and the wall of the recess collars the neck of the bottle.

So as to ensure retention of the cap in its seated condition on the bottle against the outward force of a pressurized condition developed within the bottle, means is provided for interlocking the body of the cap with the neck of the bottle. This means comprises a rib 39 about the inner wall of the body. The rib is adapted, when fitting the cap to the bottle, to resiliently snap into a complementary groove 40 about the neck of the bottle. The rib may be released from this interlocked condition by manually exerting a lifting force on a tab 42 extending about the periphery of the body.

While embodiments of the invention have been illustrated and described in detail, it is to be expressly understood that the invention is not limited thereto. Various changes can be made in the design and arrangement of the parts without departing from the spirit and scope of the invention. It is my intent, therefore, to claim the invention not only as shown and described herein, but also in all such forms and modifications as may reasonably be construed to fall within the spirit of the invention and the scope of the appended claims.

What is claimed is:

1. A cap for closing the mouth end of a bottle containing a beverage and for pressurizing the interior of the bottle with air, the cap comprising a body having a recess in a bottom end thereof adapted to receive the mouth end of the bottle, the body having a flat surfaced headpiece closing over a top end of the recess, a resilient bulb having an open bottom end seated on the headpiece, the bulb being compressible under manual pressure and adapted to re-expand to normal upon relaxing of said pressure, a normally closed spring loaded valve means in the headpiece having response to contraction of the bulb to allow air forced out of the bulb to pass through the headpiece to the mouth of the bottle, and a normally closed spring loaded ball valve means in the headpiece having response to re-expansion of the bulb to allow outside air to be drawn through the headpiece into the expanding bulb; wherein the recess in the body has a threaded wall adapted for engagement with a threaded neck of the bottle adjacent the mouth end; wherein a third normally closed spring loaded ball valve means is in the headpiece and is responsive to development of pressure above a predetermined value in the bottle to cause release of the excess pressure to atmosphere; and wherein the headpiece has a raised shoulder extending about the flat surface, and the bulb has a rib around its periphery interlocked in a complementary channel in the shoulder.

2. A cap for closing the mouth end of a bottle containing a beverage and for pressurizing the interior of the bottle with air, the cap comprising a body having a recess in a bottom end thereof adapted to receive the mouth end of the bottle, the body having a flat surfaced headpiece closing over a top end of the recess, a resilient bulb having an open bottom end seated on the headpiece, the bulb being compressible under manual pressure and adapted to re-expand to normal upon relaxing of said pressure, a normally closed spring loaded valve means in the headpiece having response to contraction of the bulb to allow air forced out of the bulb to pass through the headpiece to the mouth of the bottle, and a normally closed spring loaded ball valve means in the headpiece having response to re-expansion of the bulb to allow outside air to be drawn through the headpiece into the expanding bulb; wherein the headpiece has a raised shoulder extending about the flat surface, and the bulb has a rib around its periphery interlocked in a complementary channel in the shoulder.

3. A cap for closing the mouth end of a bottle containing a beverage and for pressurizing the interior of the bottle with air as in claim 2; wherein the recess in the body has a threaded wall adapted for engagement with a threaded neck of the bottle adjacent the mouth end.

4. A cap for closing the mouth end of a bottle containing a beverage and for pressurizing the interior of the bottle with air as in claim 2, wherein the recess in the body has a radially extending rib about its wall adapted for interlocking engagement with a complementary channel about a neck of the bottle.

5. A cap for closing the mouth end of a bottle containing a beverage and for pressurizing the interior of the bottle with air, the cap comprising: a one-piece body having an axially extending recess in its bottom end adapted to receive the mouth end of the bottle and having a top wall closing over an upper end of the recess; a manually compressible resilient bulb having an open bottom end, the bulb being mounted on the top wall with its open bottom end down upon the top wall; a first spring loaded valve means in the top wall normally closing a passage in the top wall communicating the open bottom end of the bulb with the mouth end of the bottle received in the recess of the body, the valve means being responsive to compression of the bulb to allow air forced from the bulb to pass into the bottle; and a second spring loaded valve means in the top wall normally closing an air inlet passage in the top wall to the open bottom end of the bulb, the second spring loaded valve means being responsive to re-expansion of the bulb to allow outside air to be drawn through the air inlet passage into the bulb.

* * * * *